US006104891A

United States Patent [19]

Maebashi et al.

[11] Patent Number: 6,104,891

[45] Date of Patent: Aug. 15, 2000

[54] COLOR IMAGE FORMING APPARATUS

[75] Inventors: Youichirou Maebashi; Hiroshi Sasame, both of Numazu, Japan

[73] Assignee: Canon Kabushiki Kaisha, Tokyo, Japan

[21] Appl. No.: 09/292,307

[22] Filed: Apr. 15, 1999

[30] Foreign Application Priority Data

Apr. 15, 1998 [JP] Japan ..... 10-104383

[51] Int. Cl.[7] ..... G06G 15/06

[52] U.S. Cl. ..... 399/55; 399/43; 399/53

[58] Field of Search ..... 399/53, 55, 54, 399/223, 43, 49

[56] References Cited

U.S. PATENT DOCUMENTS 5,281,981 1/1994 Kajita ..... 399/54 X
5,561,500 10/1996 Ohzeki et al. ..... 399/223 X
5,596,393 1/1997 Kobayashi et al. ..... 399/174

*Primary Examiner*—Susan S. Y. Lee
*Attorney, Agent, or Firm*—Fitzpatrick, Cella, Harper & Scinto

[57] ABSTRACT

A color image forming apparatus for forming an image through an electrophotographic process, the apparatus having an electrophotographic photosensitive member; charging device for charging the photosensitive member; exposure device for exposing the photosensitive member to light information to form an electrostatic latent image; a color developing device for developing the electrostatic latent image with color toner; a black developing device for developing the electrostatic latent image with black toner; control device for controlling an image forming operation condition to change an image quality; first integrating device for integrating an amount of color image output; second integrating device for integrating an amount of black image output; wherein the control device is responsive to a predetermined output of the first integrating device and to a predetermined output of the second integrating device which is different from the predetermined output of the first integrating device, and wherein the control device controls a condition relating to a color image output on the basis of the predetermined output of the first integrating device, and controls a condition relating to a black image output on the basis of the predetermined output of the second integrating device.

35 Claims, 7 Drawing Sheets

COLOR IMAGE FORMING APPARATUS

FIELD OF THE INVENTION AND RELATED ART

The present invention relates to an apparatus such as an electrophotographic copying machine, a printing apparatus, a facsimile machine, and the like, in particular, an image forming apparatus which outputs a color image with the use of color toners.

FIG. 7 is a flow chart for a typical conventional development bias control executed in an electrophotographic color image forming apparatus (for example, copying machine, and laser beam printer).

As a printing signal is inputted into the controlling means (CPU) of the main assembly of an image forming apparatus, a program for controlling the image development bias (hereinafter, "development bias") starts.

In this development bias program, first, whether or not it is necessary to control the development bias is determined on the basis of the number of the images (hereinafter, "print count" or "CNT") outputted since the last development bias control (step S11). In this case, the value of CNT has been stored in advance in the memory of the image forming apparatus main assembly. If the CNT since the last development bias control is no less than 100, it is determined that it is necessary to carry out another development bias control, and a step S13 is taken.

Next, whether or not it is necessary to carry out a development bias control is determined on the basis of the length of the time from the end of the printing operation for the last print to the current point in time, that is, the length of the time the image forming apparatus main assembly has not been in operation since the printing of the last print (Step S12). The length of the nonoperational time is monitored by the CPU. When the length of the nonoperational time since the last setting of the development bias is eight hours or more, there is a possibility that the environment in which the image forming apparatus is used has greatly changed since the last usage of the image forming apparatus in the environment, or that changes have occurred to the characteristics of the developing device and photosensitive drum during the interim period between the last and current usage. Therefore, it is determined that another development bias control, that is, resetting of the development bias, is necessary, and a step S13 is taken.

In step S13, the development bias is reset. In resetting the development bias, a proper bias value is calculated for each of yellow, magenta, cyan, and black toners. Then, the print count CNT, or the number of the prints produced since the last execution of the development bias control, is reset, that is, set to zero (step S14).

The pint count CNT is increased by one immediately before starting each printing sequence. Then, the printing sequence is carried out, and ended (step S16).

The conventional development bias control described above is carried out immediately prior to the starting of each printing sequence. However, the development bias control may be carried out at a time when the image forming apparatus main assembly is turned on, at the time of process cartridge replacement, or the like opportunities, in addition to the aforementioned timing, or immediately prior to the starting of each printing sequence.

Generally speaking, in a color print formed by a color image forming apparatus, the density of black toner is, related mainly to the saturation and brightness of a print, and the density of color toner (yellow, magenta, or cyan toner), that is, the toners other than black toner, is related mainly to the hue of a print. When color prints are produced with the use of a color printer and color toners, the user of the color printer tends to feel—psychologically— that image quality has drastically changed (fallen) as the print characteristic changes in terms of hue compared to the beginning of the printing operation, whereas the user does not tend to feel that image quality has changed as drastically as the user tends to feel as the print characteristic changes in terms of hue, as the print characteristic changes in terms of saturation or brightness. Therefore, it is possible to say that in the case of a color image forming apparatus, the frequency, with which control (development bias control) is executed to adjust the image formation conditions for improving the color toner related aspects of a print, should be greater than the frequency at which control is executed to adjust the image formation conditions for improving the black toner related aspects of a print. Further. in such a case as when single component magnetic black toner which is superior in durability and stability is used, there increases the difference between the frequency with which it is determined whether or not the development bias needs to be controlled for the color toner and the frequency with which it is determined whether or not the development bias needs to be controlled for the black toner.

However, in the case of a conventional color image forming apparatus, the interval with which it is determined whether or not the development bias control needs to be carried out is determined with no regard to the difference between a monochromatic black print (hereinafter, "monochromatic print") and a color print. In other words, the interval is set based on the print count accumulated by only a single counting means. Therefore, when a plurality of monochromatic prints are continuously made, the frequency with which the development bias is controlled for the color developing devices becomes unnecessarily high, because the development bias is adjusted for the color developing devices based on the print counts accumulated through the printing operation in which the color developing devices are rarely used Further, the toner density change which occurs during a printing operation is frequently related to the amount of photosensitive drum usage (cumulative length of time photosensitive drum is used). Generally, the amount of photosensitive drum usage (usage time) per monochromatic print is smaller than that per color print. Even from this point of view, therefore, it cannot be said that the conventional method for controlling the development bias is best in terms of the timing with which it is determined whether or not the development bias control should be carried out, or in terms of the number of times it is determined whether or not the development bias control should be carried out.

Further, normally, the amount of the time necessary to print a monochromatic print is shorter than the time necessary to print a color print. Therefore, when a plurality of monochromatic prints are continuously produced, the development bias control is carried out with an unnecessarily short interval. This causes the operation for determining whether or not the development bias control should be carried out to be carried out when it is unnecessary, interrupting the actual printing operation. This is inconvenient for a user.

Since the ratio or the monochromatic usage, relative to the color usage, of a color printer in recent years shows a tendency to increase, it is extremely important to rectify the above described inconvenience.

On the other hand, there has been available another method for rectifying the aforementioned inconvenience.

According to this method, whether or not the development bias control should be carried out is determined on the basis of the image count (a monochromatic print is counted as a single image, whereas a full-color image is counted as four images since four images are placed in layers to form a single color image), instead of the print count. In the case of this method, however, when a plurality of monochromatic prints are continuously produced with the use of a specific color toner alone, the interval with which the development bias control is carried out for this particular color toner becomes four times as long as the interval with which the development bias control is carried out when a plurality of full-color prints are continuously produced. As a result, it becomes impossible to keep the color toner density at a satisfactory level.

In the preceding section, the control of the development conditions in a color image forming apparatus was described. The same description can be given about the control of not only the development conditions but also general image formation conditions, for example, the charging conditions which are affected by the increase or decrease in the amount of charge, or the exposure conditions which are affected by the increase or decrease in the amount of light.

SUMMARY OF THE INVENTION

The primary object of the present invention is to make it possible to desirably set or reset the timing and frequency with which it is determined whether or not the image formation conditions should be controlled for a color image forming apparatus, to reduce the unnecessary number of times it is determined whether or not the image formation conditions should be controlled, so that it becomes possible to provide a color image forming apparatus which not only is smaller in terms of the number of the interruptions which occur during an image forming operation than a conventional color image forming apparatus, but also can form a more desirable image than a conventional color image forming apparatus.

According to an aspect of the present invention which accomplishes the above described object of the present invention, an electrophotographic color image forming apparatus comprises: an electrophotographic photosensitive member; a charging means for charging the electrophotographic photosensitive member; an exposing means for exposing the photosensitive member with light modulated with data; color developing devices for developing the electrostatic latent color image formed on the photosensitive member with the use of color toner; a black color developing device for developing the electrostatic latent black image formed on the photosensitive member; an image formation condition controlling means for changing the operational condition of the image forming means to change image quality; a first accumulating means for accumulating the amount of the outputted images of different color; and a second accumulating means, different from the first accumulating means, for accumulating the amount of the outputted black images, wherein the image formation condition controlling means changes the image formation conditions for the black image and color images of different color, on the basis of the count values from the first and second accumulating means, respectively, the former value being different from the latter value.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the preferred embodiment of the present invention will be described with reference to the appended drawings.

Figure 6:
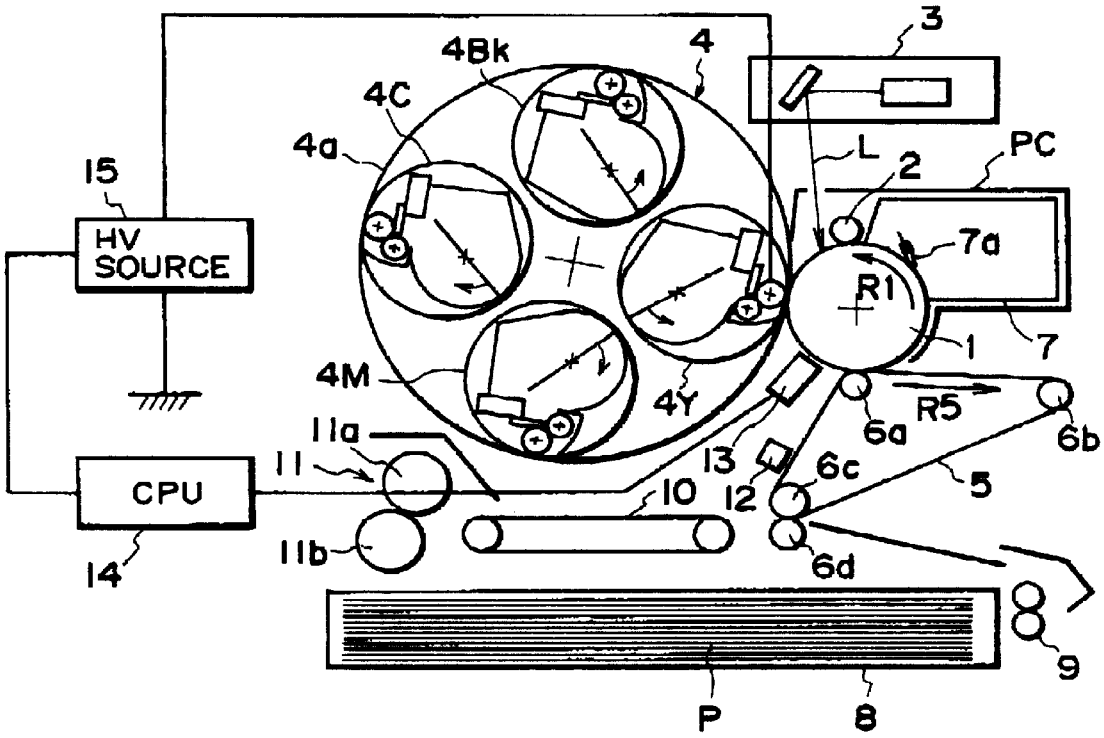
FIG. 6 is a vertical sectional view of a color image forming apparatus in accordance with the present invention, and depicts the general structure of the apparatus.
Figure 7:
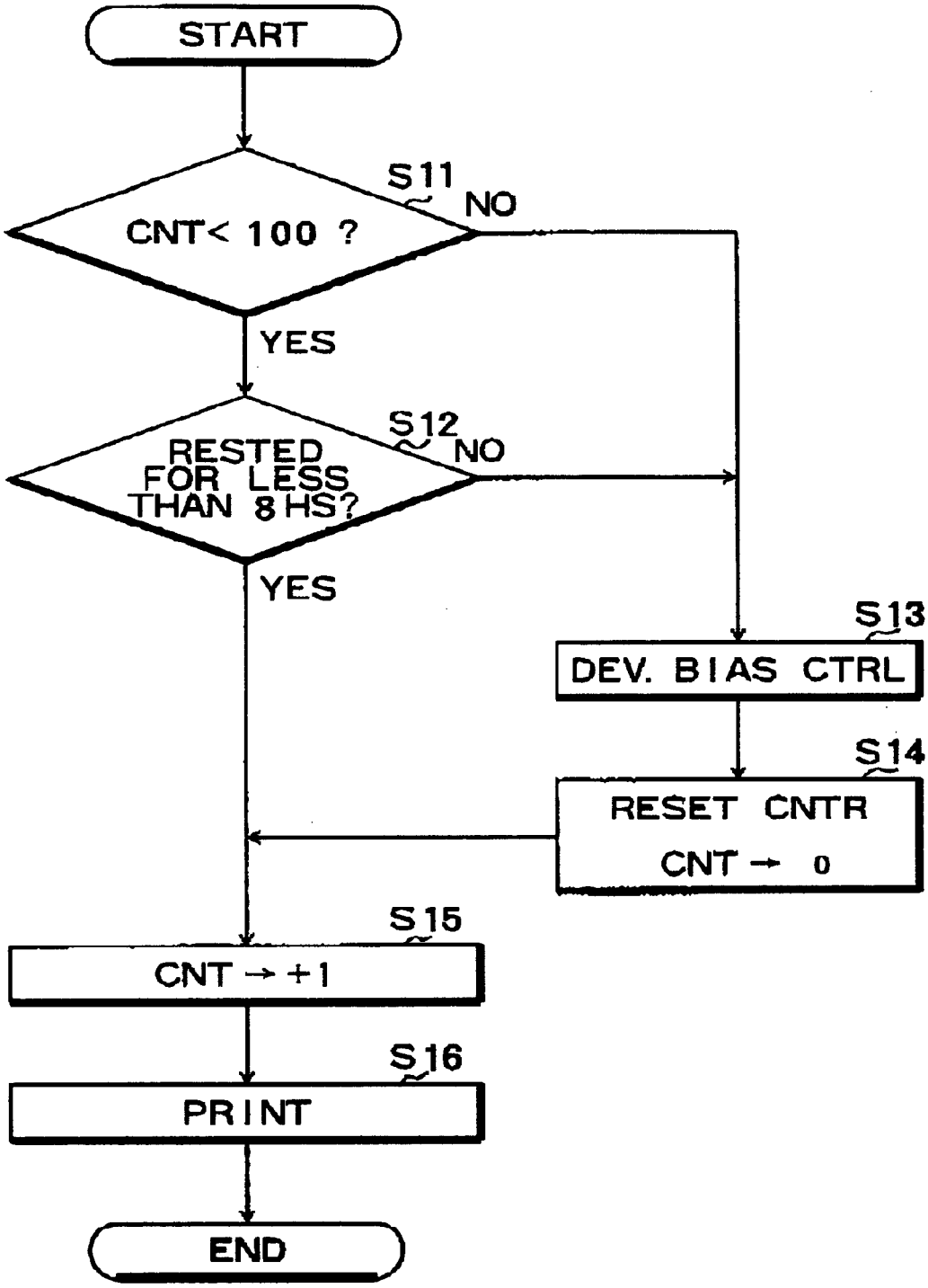
FIG. 7 is a flow chart for a conventional image formation condition control.

FIG. 6 illustrates an electrophotographic laser printer, as an example of a color image forming apparatus, in accordance with the present invention. It is a vertical sectional view of the apparatus and depicts the general structure of the apparatus.

The laser printer (hereinafter, "image forming apparatus") illustrated in the drawing is equipped with an electrophotographic photosensitive member 1 in the form of a drum (hereinafter, "photosensitive drum"). The photosensitive drum 1 is rotatively driven in the counterclockwise direction indicated by an arrow mark R1, by a driving means (unillustrated), and its peripheral surface is uniformly charged to predetermined polarity and potential level by a charging apparatus 2 (charge roller). After the charging, a laser beam L reflecting the image pattern correspondent to the first color component, that is, yellow color, is projected from an exposing apparatus 3 (laser scanner) onto the peripheral surface of the photosensitive drum 1. As a result, an electrostatic latent image is formed on the peripheral surface of the photosensitive drum 1.

The electrostatic latent image on the photosensitive drum 1 is developed by a developing apparatus 4, which comprises a rotatively drivable rotary mechanism 4*a*. and four developing devices, that is, yellow, magenta, cyan, and black developing devices 4Y, 4M, 4C, and 4Bk, in which yellow, magenta, cyan, and black toners are stored, correspondingly. The four developing devices are mounted in the rotary mechanism 4*a*. The developing apparatus 4 is structured so that each developing device can be rotatively moved by the rotation of the rotary mechanism, to a developmental position where the developing device directly faces the photosensitive drum 1. In FIG. 6, the yellow color developing device 4Y is at the developmental position. The electrostatic latent yellow image on the photosensitive drum 1 develops into a yellow toner image as yellow toner is electrostatically adhered to the latent image by the developing device 4Y.

Next, the toner image on the photosensitive drum 1 is transferred (primary transfer) onto an intermediary transfer belt 5, by applying transfer bias to the primary transfer roller 6*a*. The intermediary transfer belt S is stretched around a primary transfer roller 6*a*, a driving roller 6*b*, and a secondary transfer roller 6*c*. It rotates at approximately the same peripheral velocity as the photosensitive drum 1 in the clockwise direction indicated by an arrow mark R5 as the driving roller 6*a* rotates.

The toner which failed to be transferred onto the intermediary transfer belt 5 during the toner image transfer onto the intermediary transfer belt 5, that is, the toner which was left on the peripheral surface of the photosensitive drum 1, is removed by the cleaning blade 7*a* of a cleaning apparatus 7.

The same sequence as the above described image formation sequence, that is, the sequence composed of the charging, exposing, developing, transferring (primary), and cleaning processes, carried out for forming the yellow image is carried out for forming and transferring magenta, cyan, and black images after the formation and transfer of the yellow image. As a result, four color toner images are sequentially placed in layers on the intermediary transfer belt 5, creating a multicolor toner image composed of the plurality of color toner images.

The multicolor image formed on the intermediary belt 5 is transferred (secondary transfer) onto a piece of transfer medium P, which is stored in a sheet feeding cassette 8, and is conveyed with a predetermined timing by a sheet feeding roller 9. The multicolor toner image on the intermediary transfer belt 5 is transferred all at once by the transfer bias applied to the secondary transfer roller 6*d*, onto the surface of the transfer medium P being conveyed at the aforementioned predetermined timing. The toner which failed to be transferred onto the transfer medium P during this secondary transfer, that is, the residual toner on the intermediary transfer belt 5, is removed by a cleaning apparatus 12 with which the intermediary transfer belt 5 is provided.

The transfer medium P, onto which the multicolor toner image has been transferred, is sent to a fixing apparatus 11 by a conveyer belt 10. The fixing apparatus 11 comprises a fixing roller 11*a* and a pressure roller 11*b*. The fixing roller 11 contains a heater, and the pressure roller 11*b* is pressed upon the fixing roller 11*a*. The fixing apparatus 11 applies heat and pressure to the multicolor toner image on the transfer medium P so that the multicolor toner image fuses to the surface of the transfer medium P. As a result, the final version of a multicolor image is formed on the transfer medium P.

The above described image forming apparatus requires various types of maintenance, for example, toner replenishment, waste toner disposal, replacement of the worn photosensitive drum 1, and the like. In the case of this embodiment, the photosensitive drum 1, charge roller 2, and cleaning apparatus 7 are integrally placed in a container or a housing, forming a process cartridge PC. The developing devices 4Y, 4M, 4C, and 4Bk are also configured as development process cartridges which can be installed or removed independently from each other. Therefore, this image forming apparatus can be easily maintained by a user by replacing these process cartridges which are easily installable and removable.

Also in the case of this embodiment, the yellow, magenta, and cyan color toners are nonmagnetic, whereas the black toner is magnetic single component toner. This choice is made for the following reason. Generally speaking, a color image forming apparatus is used for producing not only a color print, but also a monochromatic print, and in recent years, the ratio of the monochromatic usage has been showing a tendency to increase. Therefore, in order to keep the monochromatic image formation cost of a color image forming apparatus as low as that of a conventional monochromatic image forming apparatus, the development process carried out by a color image forming apparatus with the use of color toner is made different from that with the use of black toner. This image forming apparatus in accordance with the present invention is one example of such color image forming apparatuses. Thus, it employs a color developing system which uses nonmagnetic color toners superior in terms of gradation reproduction and maintenance, and a black color developing system which uses magnetic single component black toner which is lower in cost, and superior in durability and image reproduction.

Generally, the toner density level at which a print is produced by an electrophotographic image forming apparatus varies in response to the environment in which the apparatus is used, or in response to the changes which occur to a developing device and a photosensitive drum as accumulated print count increases. It also varies in response to the difference in photosensitive drum characteristic in terms of photosensitivity, which occurs at the time of photosensitive drum production, and in response to the difference in toner characteristic in terms of triboelectrical chargeability, which occurs at the time of toner production. It is not easy to stabilize the toner density level against these differences and changes, in particular, in the case of a color image forming apparatus. Thus, in order to accomplish such toner density level and color balance that is desired by a user, the image formation conditions must be independently adjusted for four colors, that is, yellow, magenta, cyan, and black colors.

Thus, in this embodiment, prior to an actual image forming operation, a plurality of density level detection toner images are formed on the peripheral surface of the photosensitive drum 1 while changing in steps the image formation condition for the means used for image formation. Then, the amounts of the light reflected by the density level detection toner images are measured by an optical density sensor 13 (FIG. 6), as a density level detecting means, which is directed toward the peripheral surface of the photosensitive drum 1. Then, based on the results of the measurement, the image formation condition, which is estimated to provide a desired density level (desired amount of light reflection), is calculated by the controlling means 14 (CPU) of the image forming apparatus main assembly; the image formation condition for the actual image forming operation is set to the thus obtained image formation condition. It should be noted here that the image formation condition controlled in this image forming apparatus is the voltage level of the DC component in the development bias applied to the developing device. More specifically, the image formation condition control means adjustment of the level of the voltage applied to the developing device (developing device 4Y in FIG. 6) by a high voltage power source 15. In other words, it is nothing but the so-called development bias control.

In this embodiment, whether or not the image formation condition of the color image forming apparatus should be carried out is determined on the basis of the number of color prints and monochromatic (black) prints, which are independently counted. Therefore, the image formation condition control is carried out the minimum number of times, making it possible to reduce the image formation condition control frequency while stabilizing toner density level. Here, a print other than a black monochromatic print are all called a color print.

The color print count and monochromatic black print count, which characterize the present invention, are independently stored in two memories provided in the image forming apparatus main assembly. The cumulative number of color prints accumulated by the first accumulating means (unillustrated) is represented by a character combination $CNT_{color}$, and the cumulative number of monochrome black prints accumulated by the second accumulating means (unillustrated) is represented by a character combination $CNT_{bk}$. Whether or not a print to be produced nest is a color print or a monochromatic black print is determined based on, for example, the color separation signals inputted into the exposing apparatus 3.

First, as a print signal is inputted into the CPU 14 of the image forming apparatus main assembly, a program for determining whether or not it is necessary to reset the development bias starts.

First, whether or not it is necessary to carry out the development bias control is determined on the basis of the $CNT_{bk}$ accumulated since the last development bias resetting, that is, the last development bias control (step S1). As described previously, the toner used in the black color developing device 4Bk is a magnetic toner which is superior in durability or stability, and the optimal print count for the development bias control interval is 500. Thus, when the $CNT_{bk}$ accumulated since the last development bias control is 500 or more, it is determined that the development bias control must be carried out again. Therefore, a step S4 is taken.

Next, in the stop S1 described above, if the $CNT_{bk}$ is 500 or less, whether or not it is necessary to carry out the development bias control is determined on the basis of the current $CNT_{bk}$ since the last development bias control. The toners used in the color developing devices in this embodiment are nonmagnetic toners which are superior in color gradation, and the optimum development bias control interval in terms of print count is 100, for example. Thus, if the $CNT_{color}$ accumulated since the last development bias control is 100 or more, it is determined to be necessary to carry out again the la development bias control, and a step S4 is taken.

Next, in the aforementioned step S2, if the $CNT_{color}$ is 100 or less, whether or not it is necessary to carry out the development bias control is determined on the basis of the length of the period from the production of the last print to the current print production, during which the image forming apparatus has not been in operation. The length of this nonoperational period of the apparatus main assembly is monitored by the CPU 14. If the length of the nonoperational period of the apparatus main assembly since the last development bias control is eight hours or more, there is a possibility that the environment in which the image forming apparatus was used has drastically changed in terms of humidity, temperature, and the like factors, and also that changes have occurred to the characteristics of the developing apparatuses and the photosensitive drum 1. Therefore, it is determined that the development bias control must be carried out again, and the step S4 is taken.

Next, this embodiment of the present Invention in the form of the development bias control for an image forming apparatus will be described in detail.

Figure 2:
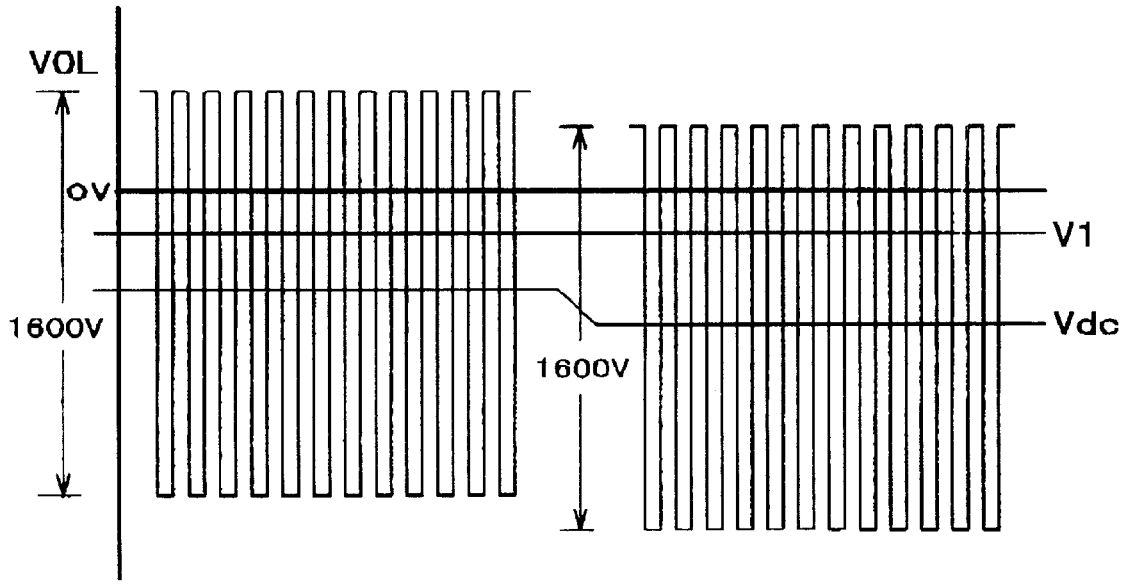
FIG. 2 is a graph which depicts the waveform of the development bias.
Figure 3:
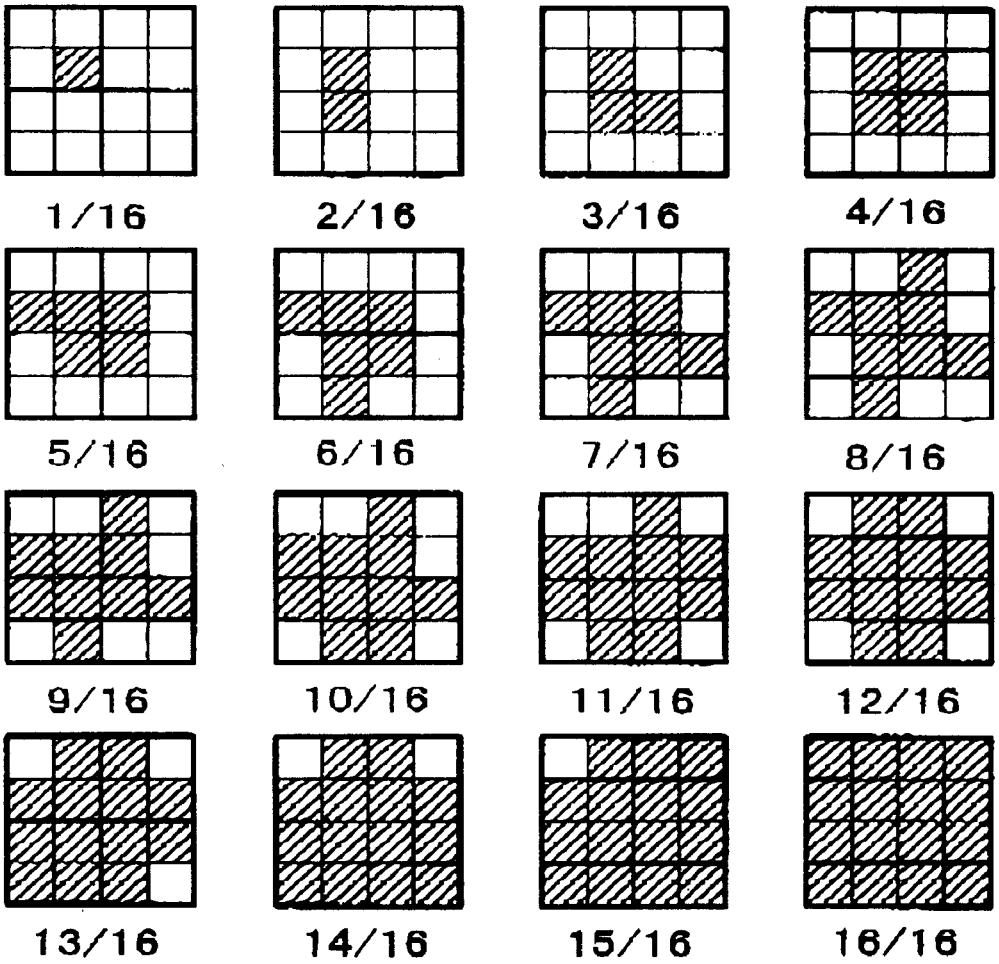
FIG. 3 shows various half-tone patterns for an image patch used for density measurement.
Figure 4:
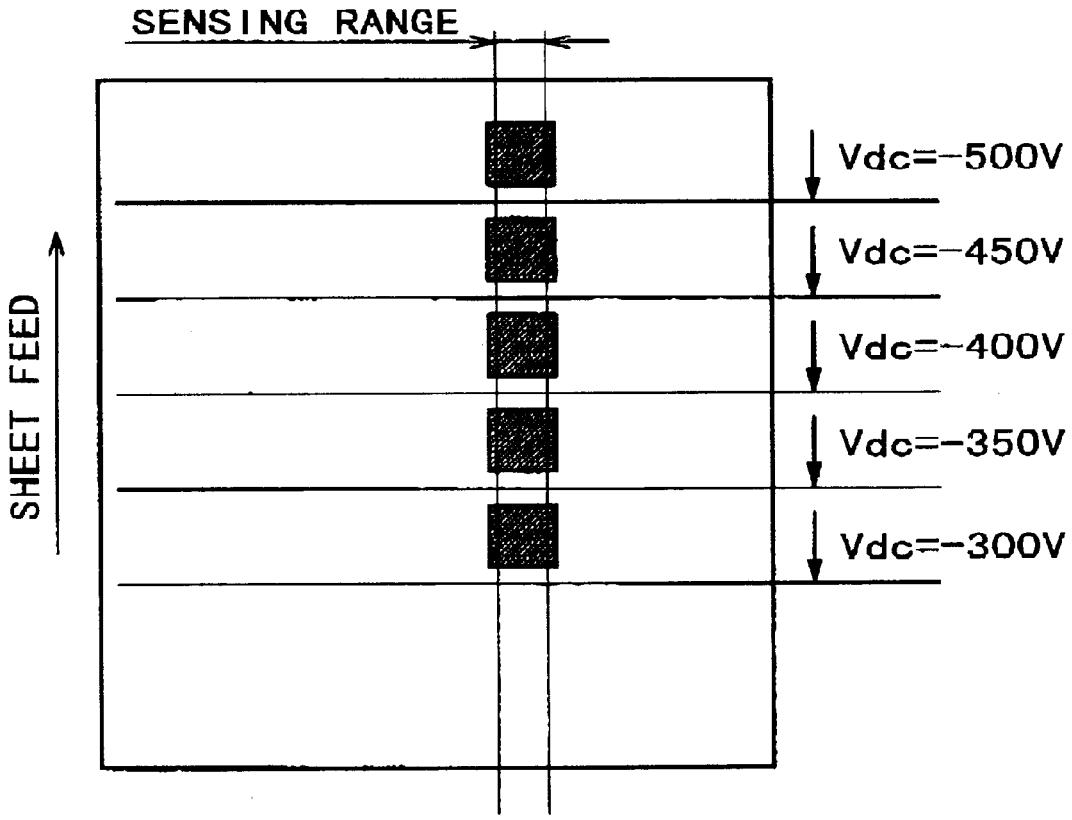
FIG. 4 is a graphic drawing which shows an example of a pattern in which image patches are aligned.

As for development bias, a compound bias composed of a DC voltage $V_{dc}$ and an AC voltage (frequency; 2,000 Hz; peak-to-peak voltage: 1,600 $V_{pp}$) with a rectangular waveform illustrated in FIG. 2 is used. The amount by which toner is transferred for latent image development is controlled by changing the voltage level $V_{dc}$ of the DC component. As for the patterns for the images (hereinafter, "image patch") used for measuring the toner density level, 4×4 dot matrices are used. More specifically, the third one from the top in the far left column in FIG. 3, that is, a half-tone pattern formed by printing nine dots, is used. Referring to FIG. 4, in measuring the toner density, a plurality of latent 30 mm×30 mm image patches of this half-tone pattern are formed on the peripheral surface of the photosensitive drum 1, in alignment with the moving direction of the peripheral surface of the photosensitive drum 1 (in the transfer medium conveyance direction), with a predetermined interval, on the area toward which the optical density sensor 13 (FIG. 6) is directed. Then, each of the plurality of the latent image patches is developed by a development bias different in the voltage level $V_{dc}$ of the DC component from the development biases used for the other latent images. Then, the amount of the light reflected by each of the obtained toner images of the plurality of the image patches is measured. In other words, in this embodiment, five latent images of the aforementioned tone density level measurement image patch are formed, and each of the five latent images is developed by a development bias different in voltage level from the development biases used for developing the other latent images. More specifically, five different development biases, the voltage levels of which range from −300 V to −500 V at an increment of 50 V, are used.

Figure 5:
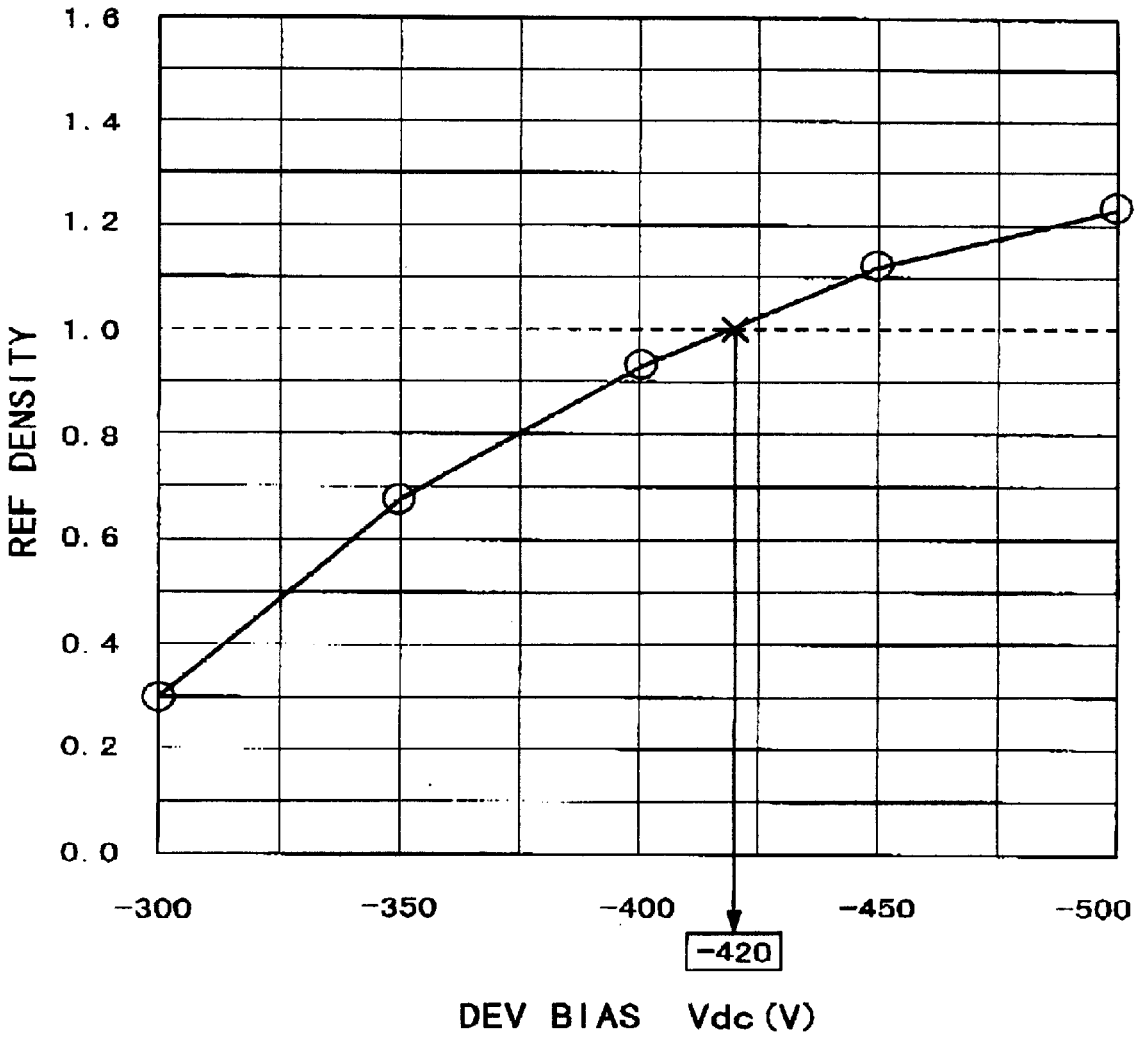
FIG. 5 is a graph which depicts the development bias control.

The results of the measurement of the level of the reflective density are shown in FIG. 5. In this embodiment, the target level (optimal density level) of the reflective density of the aforementioned half-tone pattern is set at 1.0. Thus, the development condition (in the case of this embodiment, voltage level $V_{dc}$ of DC component of development bias) is adjusted so that the following image forming operation is carried out under a development condition under which the reflection density level is closest to 1.0. More specifically, according to FIG. 5, in which the relationship between the reflection density level and the voltage level $V_{dc}$ of the DC component of the development bias is represented by five small circles, a development condition under which the reflection density level becomes 1.0 must be such that the voltage level $V_{dc}$ of the DC component of the development bias is within a range of −400 V to −450 V. Provided that the voltage level $V_{dc}$ of the DC component of the development bias and the reflection density level are approximately proportional to each other within this voltage range, it can be estimated from the graph that the reflection density level becomes 1.0 when the voltage level $V_{dc}$ is approximately −420 V. Thus, in this embodiment, the voltage level $V_{dc}$ of the DC component of the development bias, that is, one of the essential image formation conditions, is controlled so that it remains at −420 V during the following actual image forming operation. The number of the latent images of the aforementioned image patch formed on the peripheral surface of the photosensitive drum 1 in this embodiment is five. However, the number of the latent images may be increased, and also, the increment, by which the voltage level of the DC component of the development bias applied to develop the latent images of the image patch is increased, may be made smaller than the aforementioned 50 V, so that more accurate development bias control can be carried out.

The target tone density level may be changed by replacing the half-tone image patch used in this embodiment with another half-tone image patch which is different in printed dot ratio. However, if the printed dot ratio of an image patch is extremely high or extremely low, the relationship between the development bias, that is, a parameter for changing the toner density level, and the reflection density level becomes undesirable in terms of proportionality. In other words, the development bias control may cause very little change in the toner density level, or on the contrary, it may cause too much change in the toner density level, making the toner density level instable. Thus, normally, a pattern, the printed dot ratio of which is in a range of 50%–80%, is selected.

In case the development bias control alone is not sufficient, the charging condition, exposing condition (amount of exposure light), and the like may be controlled along with the development bias More specifically, the plurality of the copies of the image patch formed on the peripheral surface of the photosensitive drum 1 are measured in optical density level while varying the amount of the exposure light, and the obtained data are used to calculate the relationship, between the image formation data and the amount of the exposure light, for obtaining the optimal gradation (look-up table for reproducing optimal half-tone is created). This control also is included in the "image formation condition control" referred to in the embodiment of the present invention.

In this embodiment, the development biases for the yellow, magenta, and cyan color toners in the color developing devices 4Y, 4M, and 4C. correspondingly, are reset to the optimal level in succession, at the same time as the black toner in the black color developing device 4Bk is reset to the optimal level. This is for the following reason. If the development bias control for the black color developing device 4Bk is carried out at times different from the times when the development bias control is carried out for the color developing devices 4Y, 4M, and 4C, it sometimes occurs that the development bias is reset for the color developing devices 4Y, 4M, and 4C very shortly after the development bias control is carried out for the black color developing device 4Bk, and as a result, the color print production is interrupted after the production of only a few color prints, making a user feel uneasy or uncomfortable. Therefore, when it is determined to be necessary to carry out the development bias for the color developing devices or the black color developing device, the development bias may be reset for both the color developing devices and the black color developing device, even if one side does not require the resetting of the development bias at that point.

Figure 1:
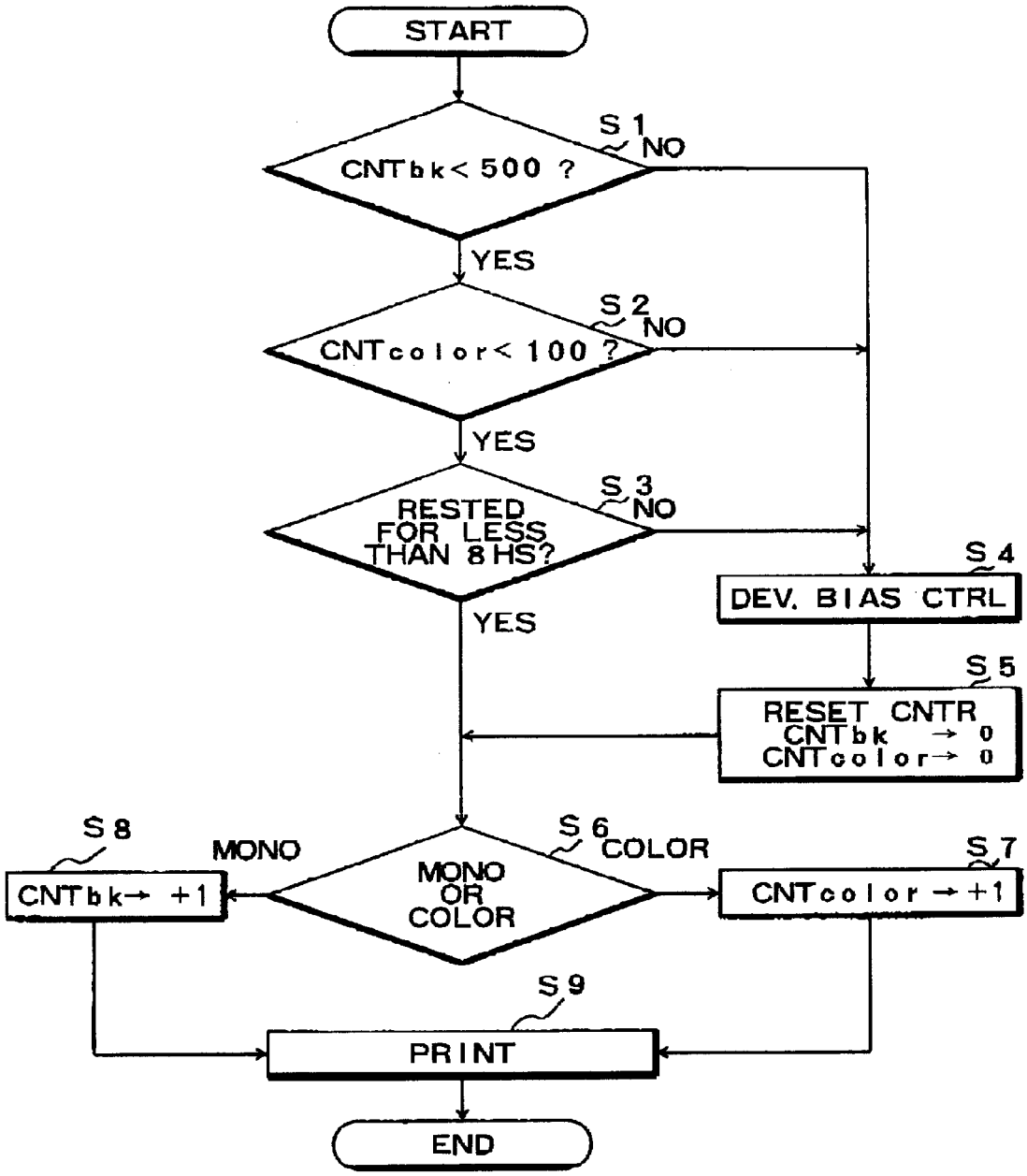
FIG. 1 is a flow chart for an image formation condition control in accordance with the present invention.

Returning to FIG. 1, both the $CNT_{color}$ and $CNT_{bk}$ are set to "zero" after the development bias control is carried out (step S5).

Next, it is determined whether or not the next print is a monochromatic black print or a color print (step S6). In this case, all monochromatic color prints, that is, all color prints which are not monochromatic black prints, are classified as a color print.

When the next print is a color print, a count of one is added to the $CNT_{color}$ immediately before printing is started (step S7). On the other hand, when the next print is a monochromatic black print, a count of one is added to the $CNT_{bk}$ immediately before printing is started (step S8)

Then, a predetermined printing sequence is carried out (stop S9), and the printing is ended after the intended images are outputted.

As described above, in this embodiment, whether or not it is necessary to reset the image formation condition for a color image forming apparatus is determined on the basis of the color print count $CNT_{color}$ and monochromatic black print count $CNT_{bk}$. which are accumulated independently from each other. Therefore, the frequency with which the image formation condition in controlled is reduced while stabilizing the toner density level at which images are produced.

Further, in this embodiment, the development bias control is carried out immediately before printing is started. However, the development bias control may be carried out at different times; for example, immediately after the power to the image forming apparatus main assembly is turned on; at the time when a process cartridge PC (FIG. 6) is replaced; or at the time of maintenance such as taking care of a paper jam. In these cases, both the $CNT_{color}$ and $CNT_{bk}$, which are the cumulative counts of color and black prints, respectively, produced after the last development bias control, are reset to zero.

Further, in this embodiment, the development bias control is carried out in succession for the four color toners, that is, yellow, magenta, and cyan color toners, and the development bias control for the black toner is carried out at the same time as when the development bias controls for the color toners are carried out. However, when the black developing device 4Bk is greatly different in durability or stability from the color developing devices 4Y, 4M, and 4C (difference is greater than that in this embodiment), there are cases in which the control for the black developing devices 4Bk and the control for the color developing devices 4Y, 4M, and 4C should be carried out at different times. This is for the following reason. For example, when the black developing device 4Bk needs to be reset for every 5,000 prints, whereas the color developing devices 4Y, 4M, and 4C need to be reset for every 100 prints, it is rare that the situation in which the black developing device 4Bk must be reset very shortly after the resetting of the color developing devices 4Y, 4M, and 4C, or vice versa, occurs. In any case, it is desired that a controlling method most suitable to the characteristics of each color image forming apparatus is selected. This does not contradict the gist of the present invention.

When the black developing device Bk is controlled at times different from the times when the color developing devices 4Y, 4M, and 4C are controlled, the $CNT_{bk}$ and $CNT_{color}$ are reset to zero after the controlling of the developing device Bk and the color developing devices 4Y, 4M, and 4C are completed, respectively.

Further, in this embodiment, when a color image is printed, only the color print count $CNT_{color}$ is accumulated. However, there are other choices, which are effective. For example, according to one such choice, first, it is determined whether a print to be produced next is a full-color print or a monochromatic color print. Then, if the print is a monochromatic color print, a count of one is added only to the color print count $CNT_{color}$, whereas if the print is a full-color print, a count of one is added to both the color print count $CNT_{color}$ and the black print count $CNT_{bk}$. This arrangement also does not contradict the gist of the present invention.

As is evident from the above description, according to the present invention, a controlling means for resetting the image formation conditions determines whether or not it is necessary to adjust the image formation conditions, on the basis of the color print count accumulated by a first accumulating means, and the monochromatic black print counts accumulated by a second accumulating means different from the first accumulating means, and reduces the frequency, with which the image formation conditions are adjusted, to the minimum level on the basis of the determination. Therefore, it is possible to output desirable images in terms of toner density level while minimizing the number of the interruptions of an image forming operation which occur as the image formation condition control is carried out.

While the invention has been described with reference to the structures disclosed herein, it is not confined to the details set forth, and this application is intended to cover such modifications or chances as may come within the purposes of the improvements or the scope of the following claims.

What is claimed is:

1. A color image forming apparatus for forming an image through an electrophotographic process, said apparatus comprising:

an electrophotographic photosensitive member;

charging means for charging said photosensitive member;

exposure means for exposing said photosensitive member to light information to form an electrostatic latent image;

a color developing means for developing the electrostatic latent image with color toner;

a black developing means for developing the electrostatic latent image with black toner;

control means for controlling an image forming operation condition to change an image quality;

first integrating means for integrating an amount of color image output;

second integrating means for integrating an amount of black image output;

wherein said control means is responsive to a predetermined output of said first integrating means and to a predetermined output of said second integrating means which is different from the predetermined output of said first integrating means, and wherein said control means controls a condition relating to a color image output on the basis of the predetermined output of said first integrating means, and controls a condition relating to a black image output on the basis of the predetermined output of said second integrating means.

2. An apparatus according to claim 1, wherein said control means controls said color developing means and said black developing means, and the forming condition includes developing bias voltages applied by said color and black developing means.

3. An apparatus according to claim 1, wherein the color toner is non-magnetic toner, and the black toner is magnetic toner.

4. An apparatus according to claim 1, wherein the predetermined output of said second integrating means is larger than the predetermined output of said first integrating means.

5. An apparatus according to claim 2, wherein, when said control means operates in response to the output of one of said first and second integrating means, said control means controls the condition of both the color image output and the black image output.

6. An apparatus according to claim 2, wherein when said control means operates in response to the output of one of either said first or second integrating means, said control means does not change a condition of the other integrating means if the output of the other integrating means does not reach its predetermined output.

7. A color image forming apparatus for forming an image through an electrophotographic process, said apparatus comprising:

an electrophotographic photosensitive member;

charging means for charging said photosensitive member;

exposure means for exposing said photosensitive member to light information to form an electrostatic latent image;

yellow, magenta and cyan developing means for developing the electrostatic latent image with corresponding color toner;

a black developing means for developing the electrostatic latent image with a black toner;

control means for controlling an image forming operation condition to change an image quality;

first integrating means for integrating an amount of color image output;

second integrating means for integrating an amount of black image output;

wherein said control means is responsive to a predetermined output of said first integrating means and to a predetermined output of said second integrating means which is different from the predetermined output of said first integrating means, and wherein said control means controls a condition relating to a color image output on the basis of the predetermined output of said first integrating means, and controls a condition relating to a black image output on the basis of the predetermined output of said second integrating means.

8. An apparatus according to claim 7, wherein the forming condition includes developing bias voltages applied by said color and black developing means.

9. An apparatus according to claim 8, wherein the color toner is non-magnetic toner, and the black toner is magnetic toner.

10. An apparatus according to claim 7, wherein the predetermined output of said second integrating means is larger than the predetermined output of said first integrating means.

11. An apparatus according to claim 10, wherein, when said control means operates in response to the output of one of said first and second integrating means, said control means controls the condition of both the color image output and the black image output.

12. An apparatus according to claim 10, wherein when said control means operates in response to the output of one of either said first or second integrating means, said control means does not change a condition of the other integrating means if the output of the other integrating means does not reach its predetermined output.

13. An image forming apparatus comprising:

image forming means for forming an image on a recording material;

density detecting means for detecting a density of a reference image;

control means for controlling an image forming condition of said image forming means on the basis of a result of detection of said density detecting means;

first counting means for counting a number of the recording materials on which images including color images are formed by said image forming means;

second counting means for counting a number of the recording materials on which monochromatic black images are formed by said image forming means;

wherein when the count provided by said first counting means reaches a first predetermined level, the image forming condition for the color image is reset by said control means, and when the count provided by said second counting means reaches a second predetermined level, said image forming condition for the black image is reset by said control means, where said first predetermined level and said second predetermined level are different from each other.

14. An apparatus according to claim 13, wherein said first predetermined level is smaller than said second predetermined level.

15. An apparatus according to claim 13, wherein when the count provided by said first counting means reaches the first predetermined level, or when the count provided by said second counting means reaches the second predetermined level, said control means resets the image forming conditions for the color image and the black image.

16. An apparatus according to claim 13 or 15, wherein when said control means resets said image forming condition for the color image, the count provided by said first counting means is reset, and when said control means resets said image forming condition of the black image, the count provided by the second counting means is reset.

17. An apparatus according to claim 13 or 15, where each time the count provided by said first counting means reaches the first predetermined level, said control means rests said image forming condition for the color image, and each time the count provided by said second counting means reaches the second predetermined level, said control means resets the image forming condition for the black image.

18. An apparatus according to claim 15, wherein said control means resets said image forming condition for the color image and the black image when a non-operative period of said image forming means exceeds a predetermined period before the count provided by said second counting means reaches the second predetermined level and before the count provided by said first counting means reaches the first predetermined level.

19. An apparatus according to claim 13, wherein said image forming means includes an image bearing member and toner image forming means for forming a toner image on said image bearing member, and the reference image is formed on said image bearing member by said toner image forming means.

20. An apparatus according to claim 13, wherein said image forming means includes an image bearing member and developing means for developing, with toner, an electrostatic image formed on said image bearing member.

21. An apparatus according to claim 20, wherein said developing means includes a color developing device containing a color toner and a black-color developing device containing black, toner.

22. An apparatus according to claim 21, wherein the color toner is non-magnetic toner, and the black toner is magnetic toner.

23. An apparatus according to claim 13, wherein said image forming means includes an image bearing member, electrostatic image forming means for forming an electrostatic image on said image bearing member and developing means for developing said electrostatic image with toner, and wherein said image forming condition is an electrostatic image forming condition of said electrostatic image forming means.

24. An image forming apparatus comprising:

image forming means for forming an image on a recording material;

density detecting means for detecting a density of a reference image;

control means for controlling a n image forming condition of said image forming means on the basis of a result of detection of said density detecting means;

first counting means for counting a number of the recording materials on which images including color images are formed by said image forming means;

second counting means for counting a number of the recording materials on which images including black images are formed by said image forming means;

wherein when the count provided by said first counting means reaches a first predetermined level, the image forming condition for the color image is reset by said control means, and when the count provided by said second counting means reaches a second predetermined level, said image forming condition for the black image is reset by said control means, wherein said first predetermined level and said second predetermined level are different from each other.

25. An apparatus according to claim 24, wherein when a full-color image is formed on one recording material by said image forming means, the count provided by said first and second counting means are incremented by one, respectively.

26. An apparatus according to claim 24, wherein said first predetermined level is smaller than said second predetermined level.

27. An apparatus according to claim 24, wherein when the count provided by said first counting means reaches the first predetermined level, or when the count provided by said second counting means reaches the second predetermined level, said control means resets the image forming conditions for the color image and the black image.

28. An apparatus according to claim 24 or 27, wherein when said control means resets said image forming condition for the color image, the count provided by said first counting means is reset, and when said control means resets said image forming condition of the black image, the count provided by the second counting means is reset.

29. An apparatus according to claim 24 or 27, wherein each time the count provided by said first counting means reaches the first predetermined level, said control means rests said image forming condition for the color image, and each time the count provided by said second counting means reaches the second predetermined level, said control means resets the image forming condition for the black image.

30. An apparatus according to claim 27, wherein said control means resets said image forming condition for the color image and the black image when a non-operative period of said image forming means exceeds a predetermined period before the count provided by said second counting means reaches the second predetermined level and before the count provided by said first counting means reaches the first predetermined level.

31. An apparatus according to claim 24, wherein said image forming means includes an image bearing member and toner image forming means for forming a toner image on said image bearing member, and the reference image is formed on said image bearing member by said toner image forming means.

32. An apparatus according to claim 24, wherein said image forming means includes an image bearing member and developing means for developing, with toner, an electrostatic image formed on said image bearing member.

33. An apparatus according to claim 32, wherein said developing means includes a color developing device containing a color toner and a black-color developing device containing black toner.

34. An apparatus according to claim 33, wherein the color toner is non-magnetic toner, and the black toner is magnetic toner.

35. An apparatus according to claim 24, wherein said image forming means includes an image bearing member, electrostatic image forming means for forming an electrostatic image on said image bearing member and developing means for developing said electrostatic image with toner, and wherein said image forming condition is an electrostatic image forming condition.

* * * * *

UNITED STATES PATENT AND TRADEMARK OFFICE

CERTIFICATE OF CORRECTION

PATENT NO. : 6,104,891

DATED : August 15, 2000

INVENTORS : YOUICHIROU MAEBASHI, et al.

It is certified that error appears in the above-identified patent and that said Letters Patent is hereby corrected as shown below:

COLUMN 1

Line 34, "(Step" should read --(step--; and
Line 54, "Pint" should read --print--.

COLUMN 2

Line 40, "used Further," should read --used. Further,--; and
Line 62, "or" should read --of--.

COLUMN 4

Line 51, "4a." should read --4a,--.

COLUMN 5

Line 1, "belt S" should read --belt 5--; and
Line 40, "11" should read --11a--.

COLUMN 6

Line 66, "are all" should read --is--.

UNITED STATES PATENT AND TRADEMARK OFFICE

CERTIFICATE OF CORRECTION

PATENT NO. : 6,104,891

DATED : August 15, 2000

INVENTORS : YOUICHIROU MAEBASHI, et al.

It is certified that error appears in the above-identified patent and that said Letters Patent is hereby corrected as shown below:

COLUMN 7

Line 10, "nest" should read --next--;
Line 30, "stop S1" should read --step S1--;
Line 40, "1a" should be deleted;
Line 60, "Invention" should read --invention--; and
Line 64, "(frequency;" should read --(frequency:--.

COLUMN 8

Line 21, "tone" should read --toner--; and
Line 63, "tone" should read --toner--.

COLUMN 9

Line 25, "4c." should read --4c,--.

COLUMN 10

Line 1, "in" should read --is--; and
Line 42, "developing" should read --black developing--.

UNITED STATES PATENT AND TRADEMARK OFFICE

CERTIFICATE OF CORRECTION

PATENT NO. : 6,104,891

DATED : August 15, 2000

INVENTORS : YOUICHIROU MAEBASHI, et al.

It is certified that error appears in the above-identified patent and that said Letters Patent is hereby corrected as shown below:

COLUMN 13

Line 14, "rests" should read --resets--; and
Line 56, "a n" should read --an--.

COLUMN 14

Line 31, "rests" should read --resets--.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*